US008251173B2

(12) United States Patent
Drew et al.

(10) Patent No.: US 8,251,173 B2
(45) Date of Patent: Aug. 28, 2012

(54) MUFFLER ATTACHMENT SYSTEM

(75) Inventors: Christopher J. Drew, West Allis, WI (US); John R. Schneiker, Muskego, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 313 days.

(21) Appl. No.: 12/508,424

(22) Filed: Jul. 23, 2009

(65) Prior Publication Data

US 2011/0017336 A1 Jan. 27, 2011

(51) Int. Cl.
*F01N 13/10* (2010.01)

(52) U.S. Cl. ..... 181/240; 181/212; 181/227; 181/228; 138/109

(58) Field of Classification Search ..... 138/109; 181/212, 227, 228, 231, 240
See application file for complete search history.

(56) References Cited

U.S. PATENT DOCUMENTS

| | | | | |
|---|---|---|---|---|
| 3,685,613 | A | 8/1972 | Snodgrass et al. | |
| 3,863,734 | A | 2/1975 | Pawlina | |
| 3,945,354 | A | 3/1976 | Johnston | |
| 4,209,177 | A * | 6/1980 | Hall | 277/608 |
| 4,252,092 | A | 2/1981 | Kaufman et al. | |
| 4,286,675 | A | 9/1981 | Tuggle | |
| 4,306,522 | A | 12/1981 | Fotsch | |
| 4,413,705 | A | 11/1983 | Inaga et al. | |
| 4,682,571 | A | 7/1987 | Kaufman et al. | |
| RE33,050 | E | 9/1989 | Tuggle et al. | |
| 4,890,690 | A * | 1/1990 | Fischer et al. | 181/240 |
| 5,383,427 | A | 1/1995 | Tuggle et al. | |
| 5,521,339 | A * | 5/1996 | Despain et al. | 181/230 |
| 5,586,523 | A | 12/1996 | Kawahara et al. | |
| 6,279,965 | B1 * | 8/2001 | Kida | 285/268 |
| 6,298,811 | B1 | 10/2001 | Sawada et al. | |
| 6,401,674 | B2 * | 6/2002 | Allen | 123/73 C |
| 6,952,056 | B2 | 10/2005 | Brandenburg et al. | |
| 6,955,043 | B2 * | 10/2005 | Schlossarczyk et al. | 60/299 |
| 6,975,216 | B2 | 12/2005 | Tharman et al. | |
| 6,998,725 | B2 | 2/2006 | Brandenburg et al. | |
| 7,025,021 | B1 | 4/2006 | Andersson et al. | |
| 7,134,418 | B2 | 11/2006 | Nagel et al. | |
| 7,146,806 | B2 | 12/2006 | Mavinahally | |
| 7,195,094 | B2 | 3/2007 | Street et al. | |
| 7,314,397 | B2 | 1/2008 | Sodemann et al. | |
| 2001/0047777 | A1 | 12/2001 | Allen | |

(Continued)

FOREIGN PATENT DOCUMENTS

| | | |
|---|---|---|
| DE | 25 23 698 A1 | 1/1976 |

(Continued)

OTHER PUBLICATIONS

International Search Report and Written Opinion for PCT/US2010/042133, mailed Sep. 28, 2010, 14 pages.

*Primary Examiner* — Forrest M Phillips
(74) *Attorney, Agent, or Firm* — Foley & Lardner LLP

(57) ABSTRACT

An engine includes an exhaust conduit having an exhaust port on an end of the exhaust conduit. The exhaust conduit has an angled inside surface that has a cross section that widens toward the exhaust port. The engine further includes a muffler having a housing with an intake pipe. The intake pipe is inserted through the exhaust port such that the intake pipe is wedged into the angled inside surface of the exhaust conduit.

20 Claims, 9 Drawing Sheets

U.S. PATENT DOCUMENTS

2005/0150716 A1* 7/2005 Nasuno et al. ..... 181/231
2005/0279318 A1 12/2005 Nagel et al.
2006/0010860 A1 1/2006 Yamaguchi et al.
2008/0035098 A1 2/2008 Menzel et al.
2008/0093862 A1 4/2008 Brandenburg et al.
2009/0038879 A1* 2/2009 Sato et al. ..... 181/228
2009/0050124 A1 2/2009 Ooniwa et al.

FOREIGN PATENT DOCUMENTS

GB 1 586 244 A 3/1981
JP 1-262321 10/1989
JP 6-317150 11/1994

* cited by examiner

MUFFLER ATTACHMENT SYSTEM

BACKGROUND

The present invention relates generally to the field of combustion engines. More specifically the present invention relates to a system for attaching a muffler to a combustion engine configured for use with power equipment, such as lawn mowers, pressure washers, secondary generators, and the like.

The combustion process associated with internal combustion engines can be quite loud. As such, combustion engines are typically equipped with mufflers to reduce noise emissions. The muffler on a small engine is typically attached directly to the exhaust outlet of the cylinder block or cylinder head, and includes a resonating chamber or chambers designed to dissipate sound. Some mufflers include perforations on the housing for exhaust gases to exit, while others include an outlet tube.

In a typical multiple-chambered, tube-outlet muffler for a small combustion engine, exhaust gases and noise enter the muffler through a conduit attached to the cylinder block. The noise is directed into a resonating chamber, where the noise is dissipated. Typically, the chamber walls are formed from the muffler housing and internal separators or baffles. The separators are perforated, such that exhaust gases and noise pass through the perforations into another chamber of the muffler, where the noise is further dissipated. Exhaust gases exit the muffler through the outlet tube. Other mufflers use a perforate outlet formed from a series of perforations in the muffler housing.

SUMMARY

One embodiment of the invention relates to an engine including an exhaust conduit. The exhaust conduit has an exhaust port on an end of the exhaust conduit. The exhaust conduit has an angled inside surface that has a cross section that widens toward the exhaust port. The engine further includes a muffler having a housing with an intake pipe. The intake pipe is inserted through the exhaust port such that the intake pipe is wedged into the angled inside surface of the exhaust conduit.

Another embodiment of the invention relates to a muffler for an internal combustion engine. The muffler includes a housing that forms an intake and an outlet of the muffler. Also, the muffler includes an outwardly extending conduit connected to the housing. The conduit is designed to be inserted into an exhaust port of an engine. The muffler further includes a flexible portion of the housing. Upon attachment of the muffler to the engine, a compression force is stored via elastic deflection of the flexible portion.

Yet another embodiment of the invention relates to an engine including a muffler. The muffler has an intake conduit extending from the muffler. The engine further includes an exhaust port, where the intake conduit is inserted into the exhaust port. Also, the engine includes at least one boss that extends from the engine. The muffler is fastened to the boss. Additionally the engine includes a muffler guard, where the muffler guard is also fastened to the boss.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
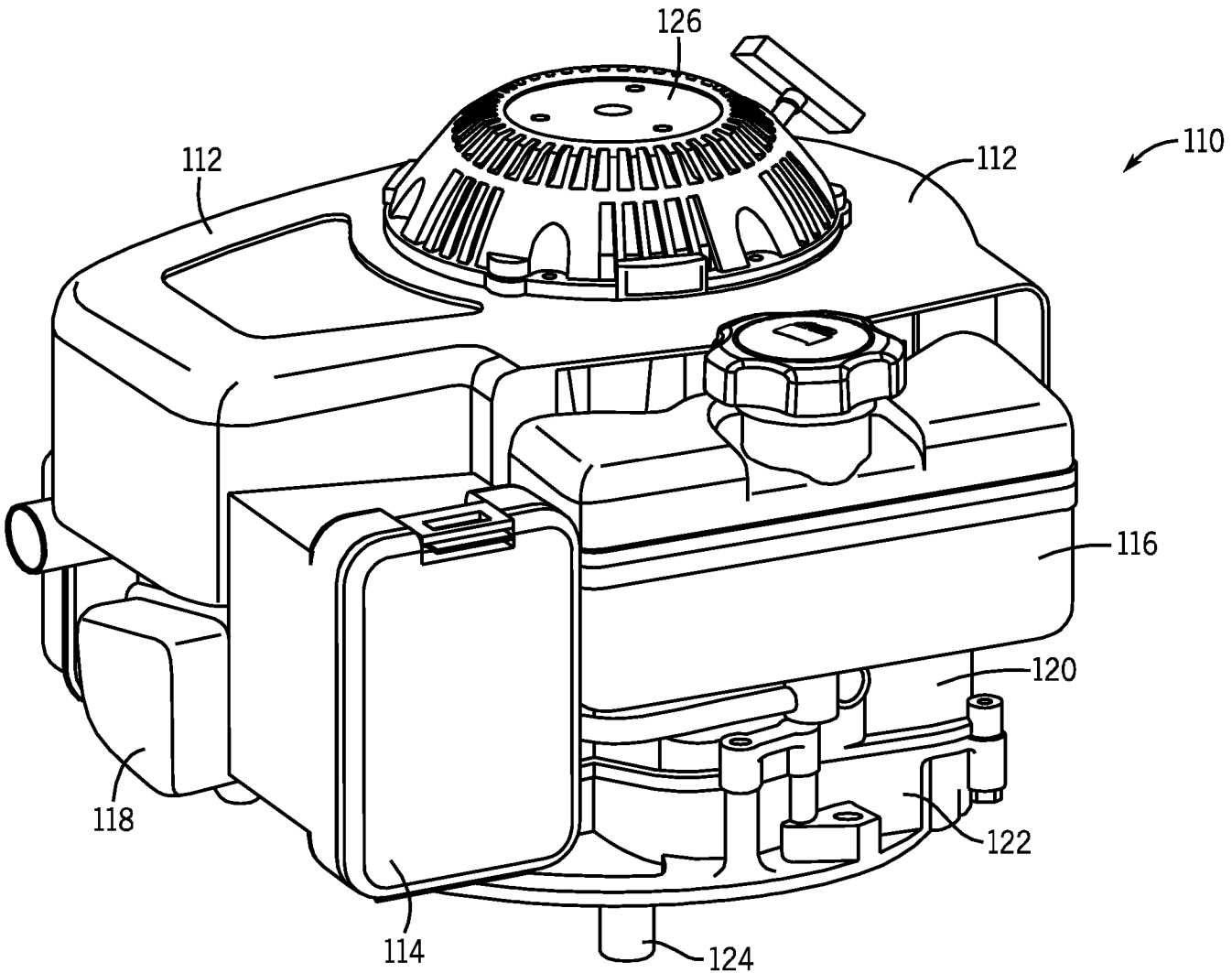
FIG. 1 is a perspective view of a combustion engine according to an exemplary embodiment.

Referring to FIG. 1, an internal combustion engine 110 includes a blower housing 112 covering a top of the engine 110, with an air intake 114 and a fuel tank 116 mounted to a side of the engine 110. A recoil starter 126 is attached to the top of the blower housing 112.

The engine 110 further includes a crankcase 120 and a sump 122 fastened to the underside of the crankcase 120. The crankcase 120 supports internal components of the engine 110, such as a piston, a connecting rod, a camshaft, and other components. The sump 122 forms a base of the crankcase 120, and holds a pool of oil lubricant within the crankcase 120. A vertical crankshaft 124 extends from the crankcase 120, through the sump 122, and may be used to drive power equipment, such as a rotary lawn mower, a pressure washer pump, a secondary generator, or other equipment. In other embodiments, the engine may include a horizontal crankshaft, an automatic starter, and the crankcase 120 and sump 122 may be integrally cast.

Figure 2:
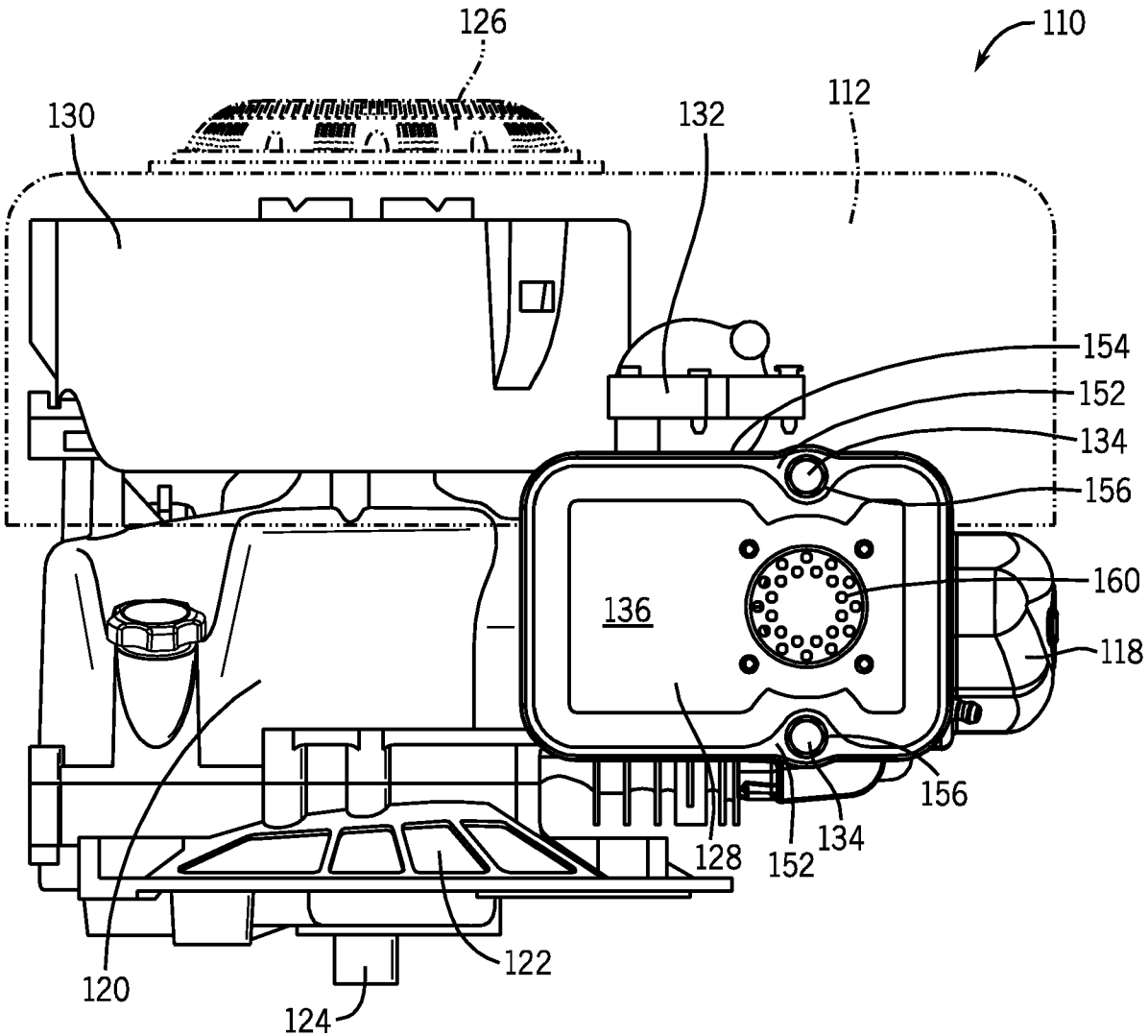
FIG. 2 is a side view of the combustion engine of FIG. 1.

FIG. 2 shows a side view of the engine 110, with various engine components not shown to better display the engine 110 structure. For example, the blower housing 112 is omitted to show components on the top of the engine 110, including a base 130 of a blower scroll, an ignition armature 132, and a rocker cover 118. The base 130 guides air from a blower fan to cool parts of the engine 110 heated as a result of the combustion process. The ignition armature 132 produces a timed electric charge used by a spark plug 144 to ignite the fuel.

The rocker cover 118 is mounted to a side of the engine 110, and encases rockers 138 (see FIG. 5) that drive intake and exhaust valves. Beneath the rocker cover 118 and rockers 138 is a cylinder head 142 covering a cylinder block 140. The cylinder head 142 caps the cylinder block 140, forming a combustion chamber. Intake and exhaust valves are controlled by the rockers, and control the flow of air in and exhaust out of the combustion chamber.

Also shown in FIG. 2, a muffler 128 is attached to a side of the engine 110. The muffler 128 reduces noise emissions from combustion processes occurring within the engine 110. The muffler 128 includes a housing 136 having a generally rectangular body formed from two shells crimped together. In other embodiments, the body may be generally circular, square, octagonal, or other shapes. The housing 136 includes mounting apertures 156, with the muffler 128 fastened to the cylinder head 142 with fasteners 134 extending through the mounting apertures 156. In the center of the muffler 128 are a series of perforations 160 on the housing 136. Exhaust gases exit the muffler 128 through the perforations 160.

While FIG. 2 shows the muffler 128 according to an exemplary embodiment, other types and forms of mufflers may also use the teachings disclosed herein. For example, in other embodiments the muffler 128 is attached to a cylinder block instead of a cylinder head. In some embodiments, the muffler 128 may be coupled to the engine 110 with other types of fasteners, such as self-tapping screws, hooks, pins, bars, welds, etc., and combinations thereof. Also, in some embodiments, the muffler 128 is attached with different numbers of fasteners. For example, in at least one embodiment, a muffler includes a loop to be engaged by a hook extending from a cylinder block. In some embodiments, the perforations 160 of the outlet are not in the center of the muffler housing. In other embodiments, the muffler outlet includes a tube through which exhaust gases exit. Muffler geometries and dimensions vary depending upon the particular frequency and amplitude of sound to be dissipated and other factors, such as an intended application.

In an exemplary embodiment, the engine 110 is a four-stroke engine. An exhaust conduit 150 (see FIG. 6) extends within the cylinder head 142. In other embodiments the exhaust conduit extends within the cylinder block 140. The exhaust gases exit the cylinder head 142 through the exhaust port 146, and into the muffler 128.

Figure 3:
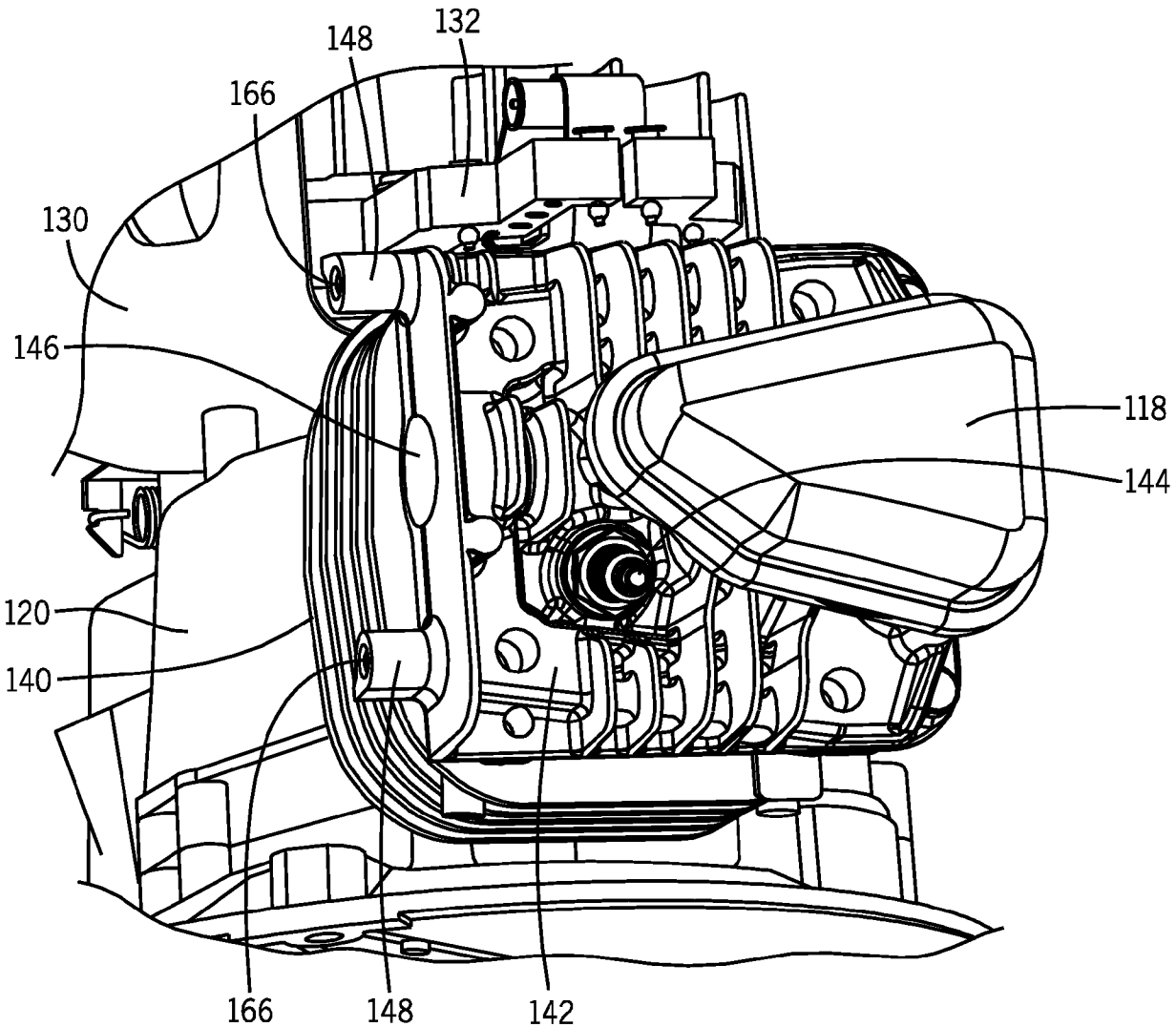
FIG. 3 is a perspective view of a cylinder block and a cylinder head according to an exemplary embodiment.

FIG. 3 shows the cylinder head 142, an exhaust port 146, and structure to attach the muffler 128 to the exhaust port 146 (with various engine components not shown to better display the structure). The exhaust port 146 is shown as a round aperture on a side of the cylinder head 142. Exhaust gases are directed from the combustion chamber, past the exhaust valve 164, and to the exhaust port 146. While FIG. 3 shows the exhaust port 146 as an aperture, in other embodiments the exhaust port is a tube or conduit extending from the engine.

Two bosses 148 extend from the cylinder head 142. The bosses 148 are positioned to the sides of the exhaust port 146, and include tapped apertures 166 to receive the fasteners 134. In an exemplary embodiment, the bosses 148 are positioned such that the centers of the bosses 148 are more than one inch from the center of the exhaust port 146 (e.g., about two inches). Placement of the bosses 148 away from the exhaust port 146 reduces heat transfer from exhaust gases exiting through the exhaust port 146. For example, sufficient distance between the bosses 148 and the exhaust port 146 allows for general purpose, self-tapping screws to be used—as opposed to specialty bolts designed to handle high temperatures without much thermal expansion. With embodiments employing self-tapping screws, the apertures 166 are cored, not tapped.

Figure 4:
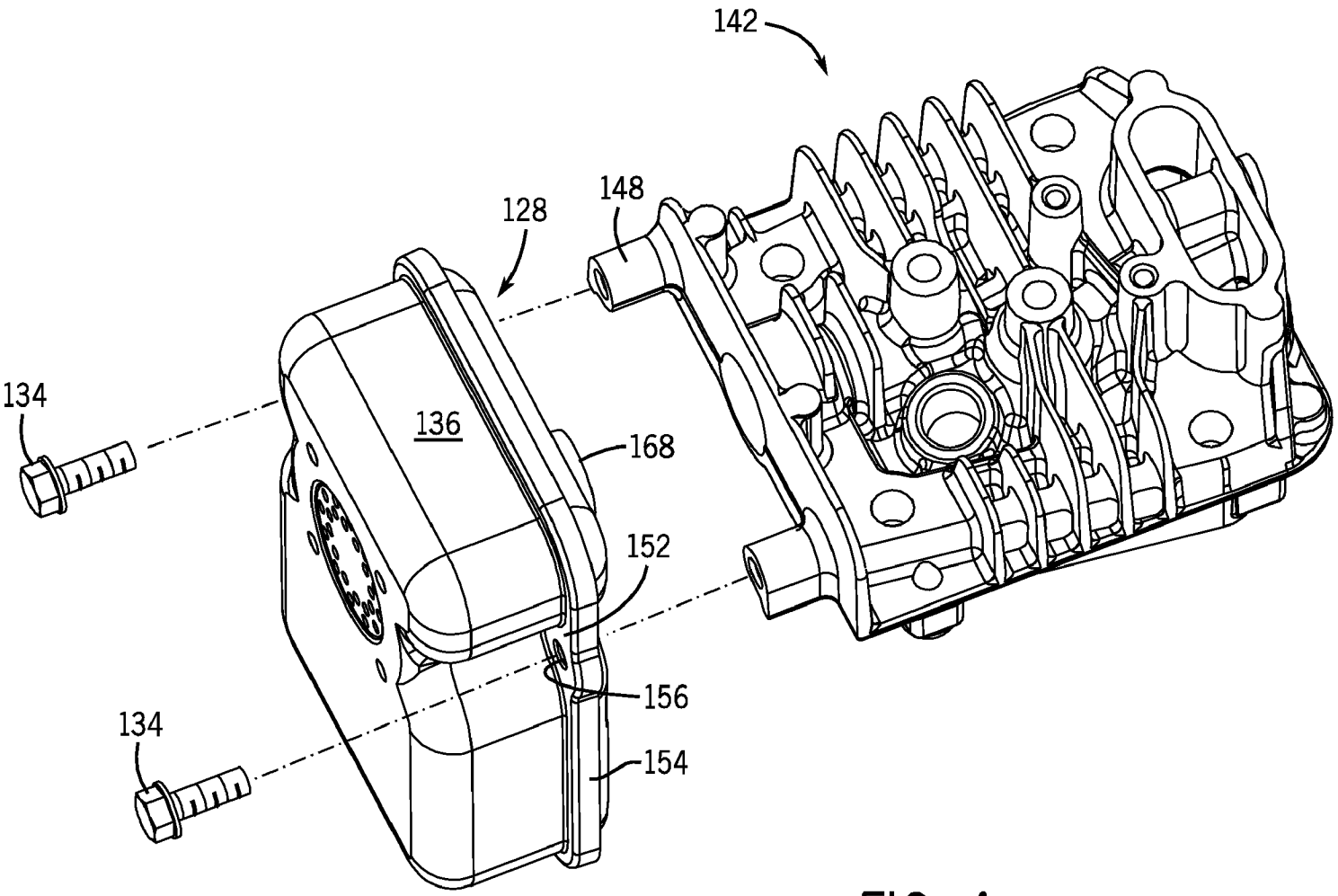
FIG. 4 is an exploded view of the cylinder head of FIG. 3 and a muffler according to an exemplary embodiment.

FIG. 4 shows an exploded view of the cylinder head 142 and the muffler 128, with fasteners 134 (e.g., screws, bolts, etc.) for attaching the muffler 128 to the cylinder head 142. When the muffler 128 is attached to the cylinder head 142, exhaust gases are directed out of the exhaust port 146 and into an intake pipe 168 of the muffler 128. As shown in FIGS. 2 and 4, the fasteners 134 pass through the apertures 156 in a flat portion 152 along an edge 154 of the muffler housing 136. Use of the flat portion 152 along the edge 154 reduces the surface area of the interface between the fasteners 134 and the muffler 128, further reducing heat transfer to the fasteners 134.

Figure 5:
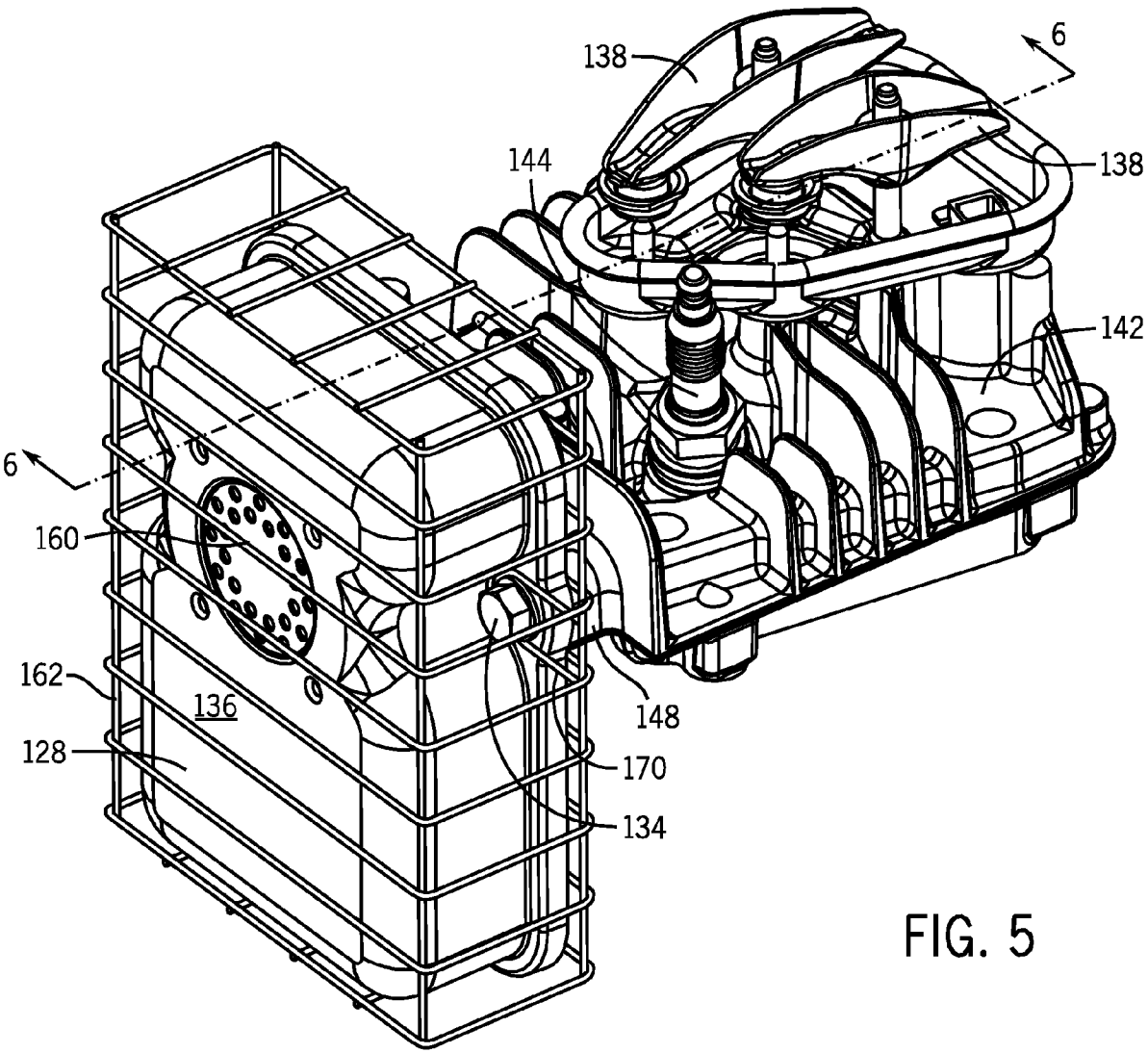
FIG. 5 is a perspective view of the muffler coupled to the cylinder head of FIG. 4 with a muffler guard, according to an exemplary embodiment.

FIG. 5 shows a perspective view of the muffler 128 fastened to the cylinder head 142 via the fasteners 134 of FIG. 4. Also shown in FIG. 5, a muffler guard, in the form of a cage 162, surrounds the muffler 128. In some exemplary embodiments, the cage 162 is made of metal bars (e.g., steel, iron, aluminum, etc.) welded together in a matrix. The cage 162 is spaced apart from the housing 136 of the muffler 128 to reduce heat transfer to the cage 162, and to limit access to the muffler 128. The cage 162 also helps prevent foreign objects, such as dry leaves or an operator, from contacting the housing 136, which may get quite hot. In other embodiments, the muffler guard is a second perforated housing, formed from a high-temperature plastic or composite shell. Still other embodiments employ other forms of commercially available muffler guards.

According to an exemplary embodiment, the cage 162 is attached to the engine 110 via the fasteners 134. For example, the fasteners 134 pass through mounting loops 170 of the cage 162. The fasteners 134 then pass through the mounting apertures 156 of the muffler 128, and into the bosses 148. In other embodiments, the fasteners first pass through the mounting apertures 156 of the muffler, then through the mounting loops 170 of the cage 162, and then into the bosses 148. Placing the bosses 148 away from the exhaust port helps to reduce heat transfer to the cage 162. Accordingly, the fasteners 134 that attach the muffler 128 may simultaneously be used to attach the cage 162. In other embodiments, different types or numbers of fasteners are used to attach the cage 162.

Figure 6:
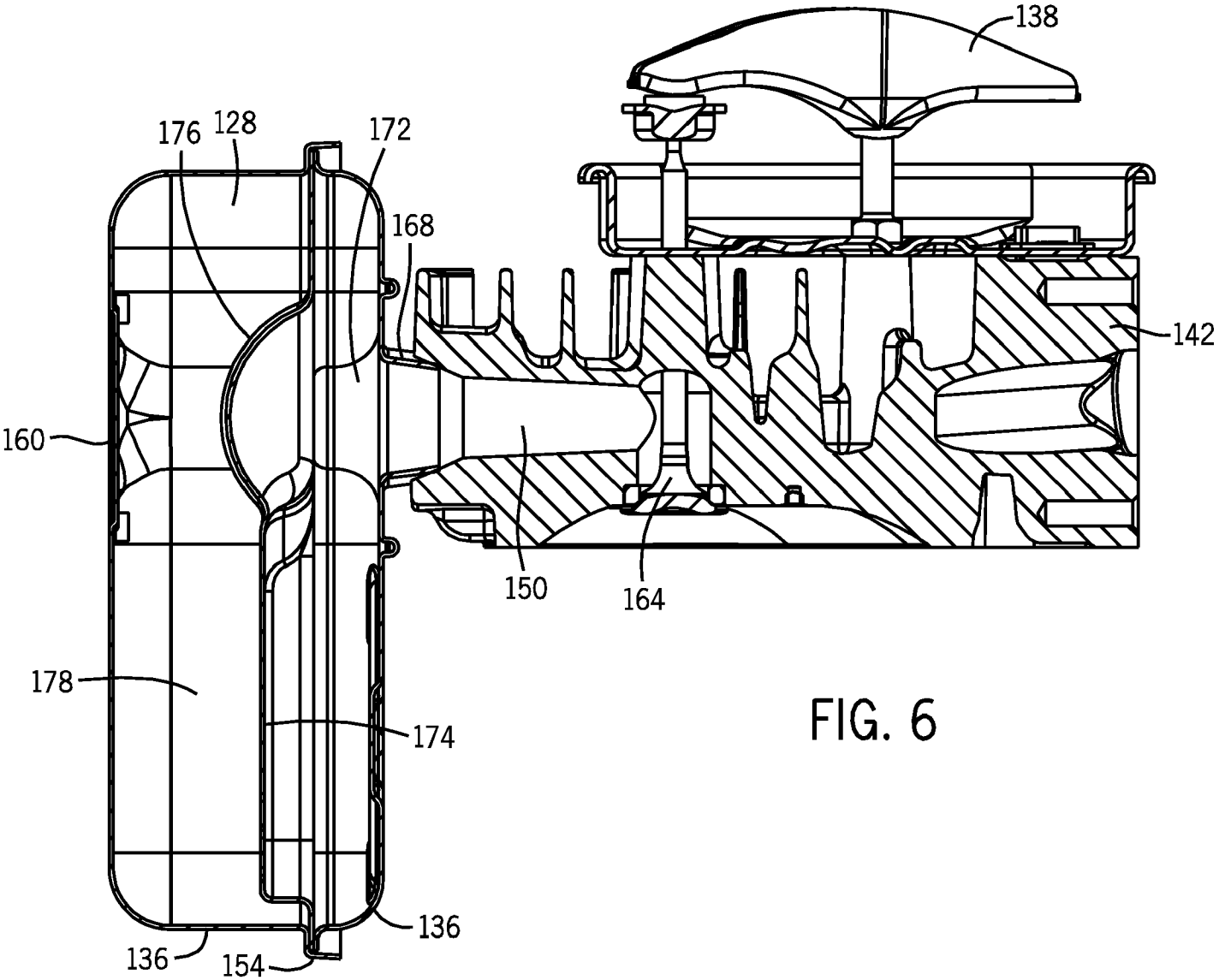
FIG. 6 is a sectional view taken generally along line 6-6 of FIG. 5.

Referring to FIG. 6, the exhaust conduit 150 is shown extending within the cylinder head 142 to the intake pipe 168 of the muffler 128. The exhaust conduit 150 is chamfered proximate to where the exhaust conduit 150 contacts the intake pipe 168 of the muffler 128. Exhaust gases entering the muffler 128 enter a first resonance chamber 172. One side of the chamber 172 is formed from a separator 174 (or baffle) within the muffler 128. The separator includes a dome-like structure 176. The other sides of the chamber 172 are formed from the housing 136. Exhaust gases pass from the first chamber 172 through a series of perforations in the separator 174, into a second chamber 178. As shown in FIGS. 2 and 6, exhaust gases exit the second chamber 178 through the perforations 160 on the housing 136. Engine noise is dissipated in the first chamber 172, and further dissipated in the second chamber 178. Other embodiments include mufflers with different numbers of chambers and separators. In some embodiments employing tube outlets, a spark arrester may be coupled to the end of the tube.

Still referring to the exemplary embodiment shown in FIG. 6, the intake pipe 168 of the muffler is tapered. The cross-sectional area of the intake pipe 168 decreases with distance away from the muffler 128. In some embodiments, the rate of decrease is linear, while in other embodiments, the rate of decrease is non-linear and not continuous. During attachment of the muffler 128 to the engine 110, the intake pipe 168 is inserted into the exhaust port 146, such that the end of the intake pipe 168 contacts chamfered walls of the exhaust conduit 150.

When the engine 110 is running, heat transfers from hot exhaust gases passing through the exhaust conduit 150 and into engine components, such as the intake pipe 168 of the muffler 128. The engine components expand, with different materials expanding at different rates and to different extents. In a preferred embodiment, the intake pipe 168 is designed so that thermal expansion of the materials will improve the seal between the intake pipe 168 and the exhaust conduit 150.

Figure 7A:
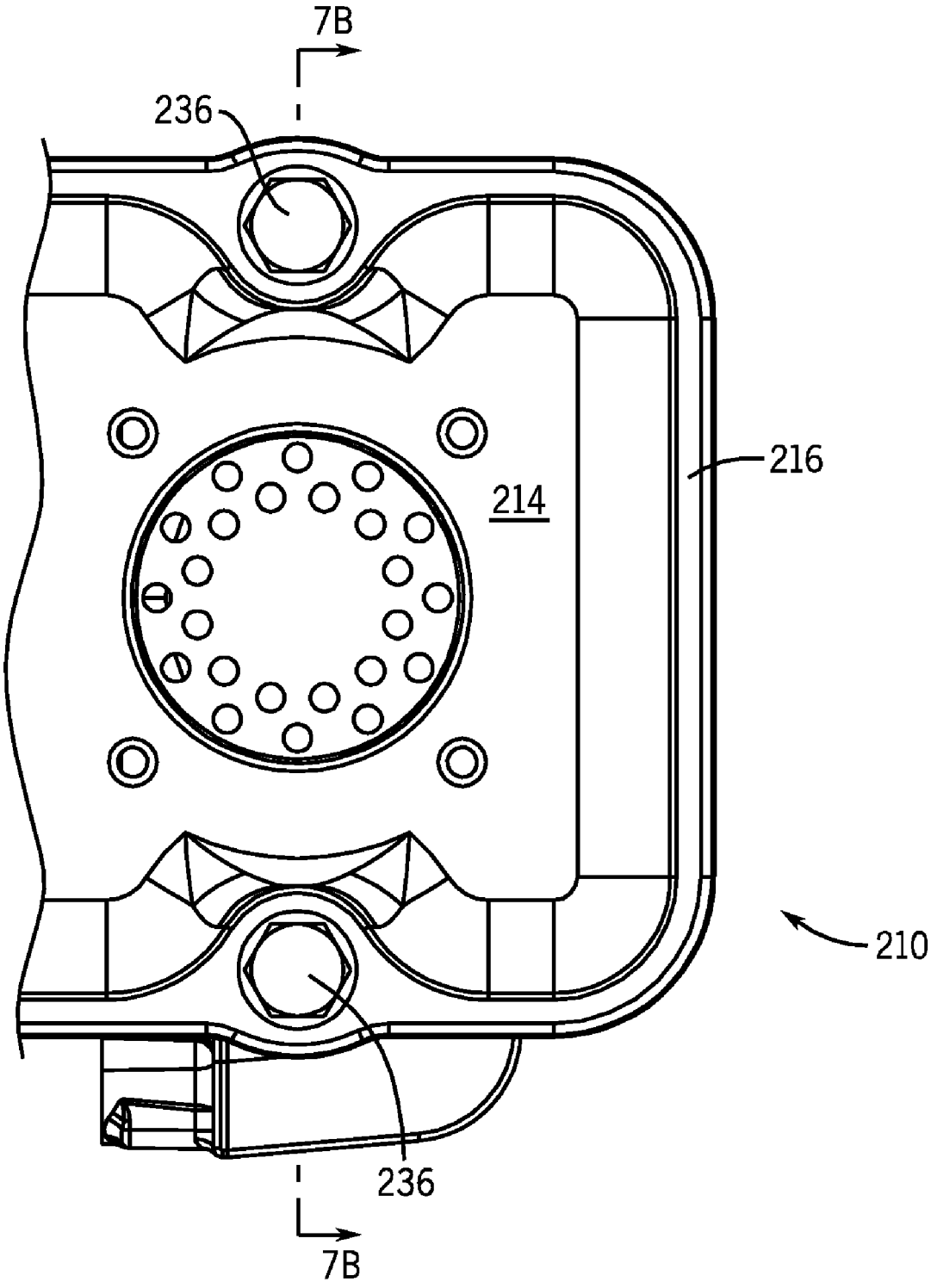
FIG. 7A is a front view of a muffler according to an exemplary embodiment.
Figure 7B:
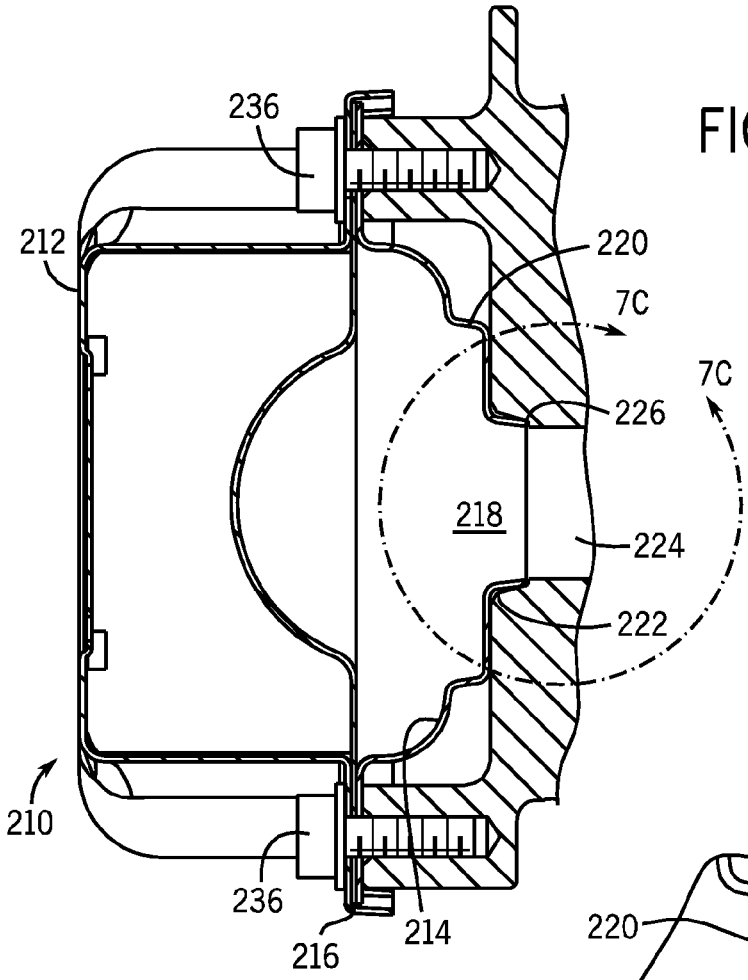
FIG. 7B is a sectional view taken generally along line 7B-7B of FIG. 7A.
Figure 7C:
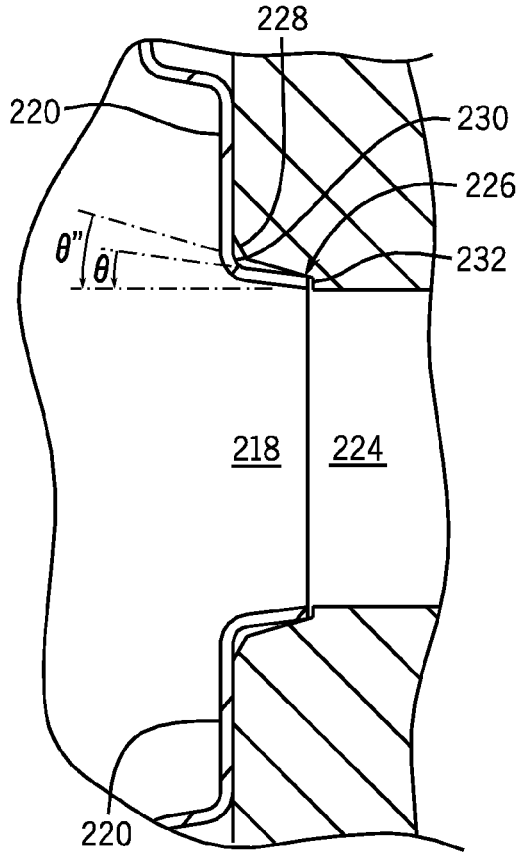
FIG. 7C an enlarged view taken generally within the encircled region 7C of FIG. 7B.

FIGS. 7A, 7B, and 7C show a muffler 210 according to another exemplary embodiment. The muffler 210 is formed from a front shell 212 and a back shell 214 crimped together around edges 216. The back shell 214 includes an intake pipe 218 extending outward from the front shell 212.

A flexible portion 220 of the back shell 214 surrounds the intake pipe 218 and has an outwardly extending curvature. When the intake pipe 218 is inserted through an exhaust port 222 and into an exhaust conduit 224, resistance from contact at an interface 226 between the intake pipe 218 and the exhaust conduit 224 generates a compressive force that is transferred through the intake pipe 218 to the flexible portion 220 of the back shell 214. The flexible portion 220 deflects, storing the force like a spring. Fasteners 236 hold the flexible portion 220 of back shell 214 in the deflected position, and the force holds the end of the intake pipe 218 tightly against the exhaust conduit 224 under pressure such that an airtight seal is formed. In other embodiments, the intake pipe 218 itself is flexible, and stores compression force when pressed into the exhaust port 222.

The exhaust conduit 224 shown in FIGS. 7B and 7C includes a bevel 228 proximate to the exhaust port 222. The bevel 228 is angled outward to facilitate positioning of the intake pipe 218 into the exhaust port 222 during assembly. Additionally, the intake pipe 218 is coupled to the back shell 214 with a rounded fillet 230. The fillet 230 reduces stress concentrations between the back shell 214 and the intake pipe 218. When coupled, the fillet 230 fits the space provided by the bevel 228.

Further referring to FIG. 7B, the exhaust conduit 224 further includes a backstop. The backstop is in the form of an annular step 232 or a shoulder at an end of a chamfered portion 234 of the exhaust conduit 224. When the intake pipe 218 is inserted into the exhaust conduit 224, the step 232 blocks the intake pipe 218 from deeper insertion. Also, the step 232 may increase the surface area of contact 226 between the intake pipe 218 and the exhaust conduit 224, providing a stronger seal. Further, the step 232 guides exhaust gases into the intake pipe 218, away from leaking between the intake pipe 218 and the exhaust conduit 224. In other embodiments, the backstop is in the form of protrusions, hooks, crossing bars, or other structures that limit the ability of the intake pipe 218 to be further inserted into the exhaust conduit 224.

Referring to FIG. 7C, in an exemplary embodiment, the angle of taper θ' of the intake pipe 218 is less than a chamfer angle θ" of the exhaust conduit 224. In some embodiments, the difference of relative angles θ', θ" is approximately between two to twenty degrees, preferably between five to ten degrees, such as about seven degrees. A meeting of two angled surfaces is intended to increase the surface area of the contact 226, producing a better seal.

Figure 8A:
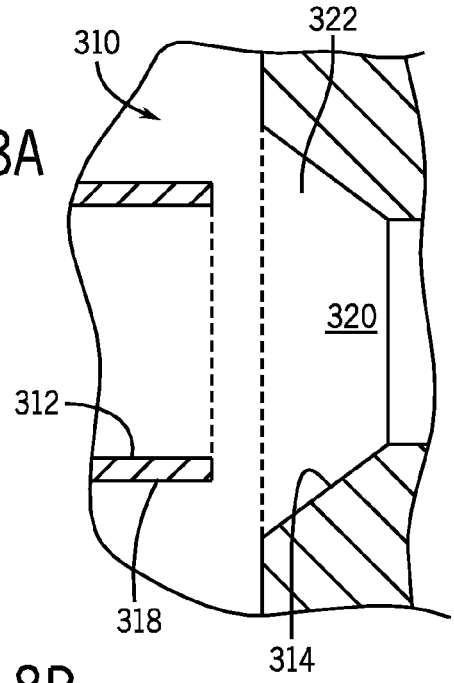
FIG. 8A is a sectional view of a fitting according to an exemplary embodiment.

FIG. 8A shows a fitting arrangement 310, with an intake 312 of a muffler and an exhaust port 314 of an engine. The intake 312 includes an intake pipe 318 having a uniform cross-section. The exhaust port 314 is formed at the end of an exhaust conduit 320. The exhaust conduit 320 has a chamfered portion 322 with a widening cross-sectional area leading to the exhaust port 314. The intake pipe 318 may be inserted into the chamfered portion 322, where an end of the intake pipe 318 contacts walls of the exhaust conduit 320. As the intake pipe 318 is inserted, some of the insertion force compresses an interface between the intake pipe 318 and the chamfered portion 322, producing an airtight seal.

Figure 8B:
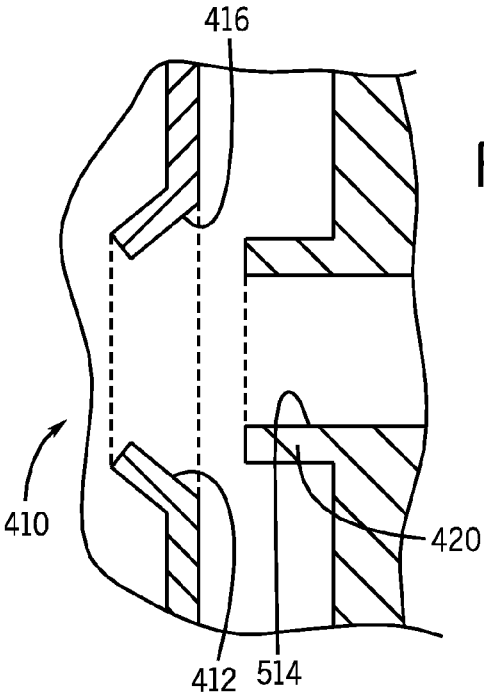
FIG. 8B is a sectional view of a fitting according to another exemplary embodiment.

FIG. 8B shows a fitting arrangement 410, with an intake 412 of a muffler and an exhaust port 414 of an engine. The intake 412 has a chamfered aperture 416 with a cross section that narrows into the muffler. An engine exhaust conduit 418 includes an outwardly extending pipe 420, with the exhaust port 414 formed at an end of the exhaust pipe 420. The exhaust pipe 420 may be inserted into the chamfered aperture 416 of the muffler intake 412. As with the fitting 310 shown in FIG. 8A, a coupling force, which holds the muffler to the engine, produces a compression force at an interface between the intake 412 and the exhaust pipe 420.

Figure 8C:
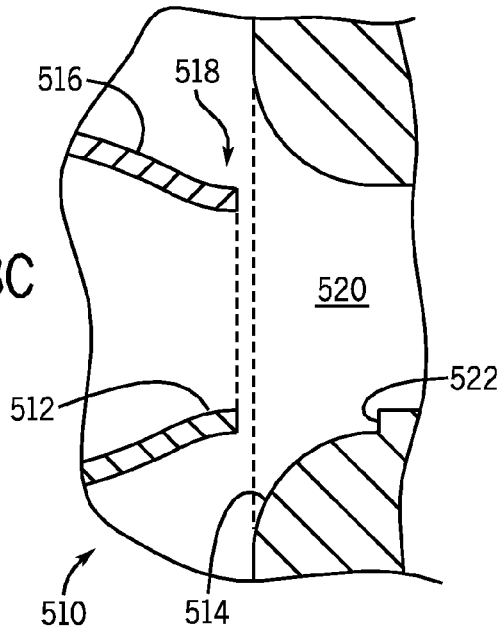
FIG. 8C is a sectional view of a fitting according to yet another exemplary embodiment.

FIG. 8C shows a fitting arrangement 510, with an intake 512 of a muffler and an exhaust port 514 of an engine. The intake 512 includes an intake pipe 516 having a rounded end 518 with a cross-sectional area narrowing away from the muffler. In some embodiments, the rate of narrowing is not constant. The exhaust port 514 is formed at the end of an exhaust conduit 520. The exhaust conduit 520 has a cross-sectional area that widens away from the engine. In some embodiments, the rate of widening is not constant. The exhaust conduit 520 further includes a step 522 that serves has a backstop to limit a distance of insertion of the intake pipe 516 into the exhaust conduit 520.

The construction and arrangements of the muffler attachment, as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. In some embodiments, fitting attachments taught herein may be applied to fittings between components in power equipment that do not include a muffler. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An engine, comprising:

an exhaust conduit comprising an exhaust port on an end thereof, wherein the exhaust conduit has an angled inside surface having a cross section widening toward the exhaust port; and a muffler comprising a housing with an intake pipe, wherein the intake pipe tapers with respect to distance from the housing, wherein the intake pipe is inserted through the exhaust port such that the tapered surface of the intake pipe is wedged into the angled inside surface of the exhaust conduit.

2. The engine of claim 1, further comprising a fastener and a boss, the fastener extending through a mounting aperture in the housing of the muffler, and into the boss, whereby the muffler is fastened to the engine.

3. The engine of claim 2, wherein the boss is a distance greater than one inch from the exhaust port.

4. The engine of claim 3, further comprising a muffler guard, the muffler guard fastened to the boss with the fastener.

5. The engine of claim 4, wherein the mounting aperture in the housing extends from a side thereof, and the fastener does not pass directly through a chamber of the muffler.

6. The engine of claim 1, wherein the exhaust conduit further includes a backstop limiting deeper insertion of the intake pipe into the exhaust conduit.

7. The engine of claim 6, wherein in the backstop is an annular step extending around the inside surface of the exhaust port.

8. The engine of claim 7, wherein the exhaust conduit further includes a bevel adjacent to the exhaust port, and wherein the bevel is on one side of the angled inside surface of the exhaust conduit and the annular step is on the other side of the angled inside surface.

9. The engine of claim 1, wherein the tapered surface of the intake pipe and the angled inside surface of the exhaust conduit interface with one another to form an airtight seal.

10. The engine of claim 9, wherein the angular difference between the tapered surface of the intake pipe and the angled inside surface of the exhaust conduit at the interface is in the range of five to ten degrees.

11. A muffler for an internal combustion engine, the muffler comprising:

a first shell;

an intake conduit; and a second shell coupled to the first shell and comprising an outlet, wherein the intake conduit is outwardly extending from the first shell, and wherein the intake conduit is configured to be inserted into an exhaust port of an engine, wherein the first shell comprises a flexible portion that surrounds the intake conduit; and wherein, upon attachment to the engine, compression force is stored via elastic deflection of the flexible portion of the first shell, thereby pressing the intake conduit into the exhaust port such that a seal is formed.

12. The muffler of claim 11, wherein the intake conduit is tapered with respect to distance from the first shell.

13. The muffler of claim 11, wherein the flexible portion of the first shell comprises an outwardly extending curvature.

14. The muffler of claim 13, wherein the outwardly extending curvature is arcuate in a lateral cross-section of the muffler.

15. An engine, comprising:

a muffler having an intake conduit extending therefrom;

an exhaust port formed in a part of the engine comprising at least one of a cylinder head and a cylinder block, the intake conduit of the muffler coupled to the exhaust port, a boss extending outwardly from the part of the engine to the side and forward of the exhaust port, wherein the muffler is fastened to the boss such that the boss provides a separation between the muffler and the part of the engine; and a muffler guard, wherein the muffler guard is fastened to the boss.

16. The engine of claim 15, further comprising a threaded fastener that extends through a mounting aperture in the muffler, through a mounting loop in the muffler guard, and into the boss.

17. The engine of claim 15, wherein the muffler includes a housing comprising first and second shells, wherein the first shell comprises a flexible portion having an outwardly extending curvature that surrounds the muffler intake conduit and flexes in response to a compression of the muffler intake conduit when the muffler intake conduit is inserted into the exhaust port, forming an airtight seal over the exhaust port.

18. The engine of claim 15, wherein the muffler guard surrounds the muffler, providing a barrier to limit access to the muffler.

19. The engine of claim 18, wherein the muffler guard is a cage formed from metal bars that is attached to the part of the engine via fasteners that pass through a mounting loop of the cage, a mounting aperture of the muffler, and into the boss.

20. The engine of claim 15, wherein the boss is a distance greater than one inch from the exhaust port.

* * * * *